US005192826A

United States Patent [19]

Aoki

[11] Patent Number: 5,192,826

[45] Date of Patent: Mar. 9, 1993

[54] ELECTRONIC MUSICAL INSTRUMENT HAVING AN EFFECT MANIPULATOR

[75] Inventor: Eiichiro Aoki, Hamamatsu, Japan

[73] Assignee: Yamaha Corporation, Hamamatsu, Japan

[21] Appl. No.: 636,209

[22] Filed: Dec. 31, 1990

[30] Foreign Application Priority Data

Jan. 9, 1990 [JP] Japan ..... 2-2093

[51] Int. Cl.[5] ..... G10H 1/02

[52] U.S. Cl. ..... 84/737; 84/626; 84/662; 84/743

[58] Field of Search ..... 84/600, 603, 626, 627, 84/629, 631, 644, 658, 662, 664, 670, 718, 737, 743, 690, 483.1, 486, 487, DIG. 7

[56] References Cited

U.S. PATENT DOCUMENTS 4,257,305 3/1981 Friend et al. ..... 84/DIG. 7 X
4,430,917 12/1984 Pepper, Jr. ..... 84/DIG. 7 X
4,810,992 3/1989 Eventoff ..... 338/99
4,852,443 8/1989 Duncan et al. ..... 84/DIG. 12 X
4,868,869 9/1989 Kramer ..... 84/622 X
4,932,304 6/1990 Franzmann ..... 84/671
4,968,877 11/1990 McAvinney et al. ..... 84/645 X
4,972,496 11/1990 Sklarew ..... 382/13
5,008,497 4/1991 Asher ..... 178/18

*Primary Examiner*—William M. Shoop, Jr.
*Assistant Examiner*—Jeffrey W. Donels
*Attorney, Agent, or Firm*—Graham & James

[57] ABSTRACT

An electronic musical instrument includes a tone generator, a manipulator for defining a manipulation region and for performing manipulation within the manipulation region. The manipulator has a first detector which detects serial position data on the basis of positions of performance manipulation within the manipulation region, and a second detector which generates changing-degree data of a locus which is constituted by the serial position data. The tone generator generates musical tone with effect in accordance with the changing-degree data to thereby impart various effect such as vibrato with ease.

13 Claims, 13 Drawing Sheets

| | | |
|---|---|---|
| A $(X_1, Y_1)$ | $\angle AOB = \omega_2$ | $\angle OAB = \beta$ |
| B $(X_2, Y_2)$ | $\angle BOC = \omega_1$ | $\angle OBC = \alpha$ |
| C $(X_3, Y_3)$ | $\angle AOC = \omega$ | |

ELECTRONIC MUSICAL INSTRUMENT HAVING AN EFFECT MANIPULATOR

BACKGROUND OF THE INVENTION a) Field of the Invention

The present invention relates to an electronic musical instrument and more particularly relates to an electronic musical instrument suitable for generating parameters for controlling musical tones of a rubbed string instrument or a wind instrument with no use of bow-string combinations, reeds, or the like.

b) Description of the Related Art

Most of real time performance manipulators of electronic musical instruments have been made of keyboards. A keyboard has a plurality of keys corresponding to respective pitches. When a key of the keyboard is depressed, a key switch associated with the depressed key is closed (set to "make") to generate a pitch signal corresponding to the pitch assigned with the depressed key.

As means for controlling the effect of generated musical tones, there are means using transverse and longitudinal vibration of the whole of the keyboard, what is called a pitch bend wheel, which controls a pitch of tone rotating motion, provided in the vicinity of a side of the keyboard, and a after-touch, (which control musical tone parameters by pressure, force and so on applied on a key after key-depression) control in which the keyboard is pushed down to its lowermost position in use.

Those electronic musical instruments equipped with such a keyboard are suitable to simulate the tones of keyboard instruments such as a piano, an organ, etc.

Other electronic musical instruments include a guitar synthesizer, a wind controller, etc. The guitar synthesizer is suitable to simulate the musical tones of a guitar. The wind controller is suitable to simulate the musical tones of wind instruments.

A rubbed string instrument such as a violin determines the pitches of musical tones based on the position of the string pressing finger on the fingerboard and changes the expression of the musical tones in a variety of ways, based on the speed of the string rubbing bow and the pressure of the string pressing bow. One of the musical tone effects peculiar to the rubbed string instrument is "vibrato" in which a vibratory pitch is formed by vibrating the string pressing finger at the position of the finger on the fingerboard.

Other musical tone effects include "tremolo" forming a vibratory volume instead of a vibratory pitch, "céleste" bringing about a phase variation to thereby generate a beat, "chorus", etc.

Further, with respect to a wind instrument for generating the musical tone in accordance with the breath pressure and embouchure (representing the posture, closure, etc., of the lips) as disclosed in Japanese Patent Application Laid-Open No. Sho-63-40199, the information required for controlling musical tones varies according to the execution, such as tonguing execution, long tone execution, with which the tonguing is not accomplished, etc.

When the musical tones of such a rubbed string instrument are to be simulated by an electronic musical instrument, it is possible to generally consider two ways.

One is a method in which basic performance manipulators of a rubbed string instrument such as a bow, strings and a fingerboard are directly used, and, for example, the vibration of a string is transformed into an electric signal which is processed electronically. The other is a method in which, without using a bow, strings and a fingerboard, etc. of the natural rubbed string instrument, manipulators such as a keyboard, etc., different from those of the natural rubbed string instrument are used as the basic performance manipulators to thereby simulate musical tones based on the performance of such manipulators.

When a bow, strings and a fingerboard similar to those of the natural musical instrument are used as the performance manipulators to cause actual vibrations of a string according to the one method, a rubbed string electronic instrument capable of achieving performance rich in expression can be realized. Of course, effect control such as "vibrato" can be made. However, the performance using the performance manipulators similar to those of the natural rubbed string instrument requires techniques of a high grade and long-term exercise for its mastering. Therefore, those who are not well-trained in performance techniques cannot enjoy the performance of the rubbed string instrument.

According to the other method, for example, the harmonics construction of the basic tone-colors of the violin is preliminarily studied to enable the basic musical tones to be synthesized electronically. Then, the tones of the violin, etc. are generated in response to the keyboard manipulation. The tone of the violin can change its musical expression in a variety of ways according to its bow speed, bow pressure, etc. while the bow is in contact with the string. Further, effect control such as "vibrato" can be added thereto. However, in the keyboard input electronic instrument, it is difficult to control the way of tone generation, the continuous change of the tone, the expression thereof, the effect thereof, etc. exactly according to the player's will. Further, the keyboard input electronic instrument cannot be manipulated easily.

In the electronic musical instrument of the type in which effects such as "vibrato", etc. are controlled by the displacement of the keyboard, manipulation may be made easily. However, in the case of a touch responsive keyboard, when effect control is to be made after hitting a key intensively, the keyboard may be transversely or longitudinally vibrated against the player's will. There arises a problem in that an exact pitch cannot be obtained when a key is hit intensively.

In the case of a pitch bend wheel, one hand is required for the operation of the wheel. There arises a problem in that the degree of freedom in performance is narrowed and manipulation cannot be made easily.

Vibrato control by touch such as after-touch control has a problem in that effect control is made regardless of the player's will when a key is hit intensively.

In the case of a guitar synthesizer, a wind controller, etc., tones similar to those of specific tone generators (a guitar, a wind instrument) can be controlled easily because the tone generation form thereof is similar to that of the specific tone generators. However, other musical tones are not natural when, for example, effect control is made to simulate tones of a rubbed string instrument. When effect control is to be made to simulate tones of such an instrument, manipulation cannot be made easily.

As described above, the keyboard type electronic musical instruments according to the conventional techniques have limitations in musical tone effect control and are not always easy to manipulate.

SUMMARY OF THE INVENTION

An object of the present invention is to provide an electronic musical instrument having a novel function.

Another object of the present invention is to provide an electronic musical instrument capable of controlling the effect of the musical tone easily.

A further object of the present invention is to provide an electronic musical instrument capable of giving a specific effect to the musical tone selectively according to the player's will.

According to an aspect of the present invention, there is provided an electronic musical instrument comprising: manipulation means for defining a manipulation region of at least two dimensions and for achieving performance manipulation within the manipulation region; means for detecting time-series position data on the basis of positions of performance manipulation executed within the manipulation region; means for detecting direction-conversion data pertaining to a locus of performance manipulation, on the basis of a predetermined number of time-serially detected position data; and a tone signal generation circuit for performing effect control on musical tones by using the detected direction-conversion data.

Preferably, the electronic musical instrument further comprises a changeover switch, so that the tone signal generation circuit generates tone signals subjected to the musical tone effect control by using the direction-conversion data when the changeover switch is set to one side, while the tone signal generation circuit generates tone signals without using the direction-conversion data when the changeover switch is set to the other side.

Preferably, the direction-conversion data detecting means detects an angle between a first radius and a second radius from the coordinates of three time-series points under the condition that the first radius is assumed to be a segment between the first one of the three time-series points and a center of a circle circumscribed with a triangle determined by the three points and the second radius is assumed to be a segment between the last one of the three time-series points and the center.

Preferably, the direction-conversion data detecting means detects an angle between a first direction and a second direction under the condition that the first direction and the second direction are assumed to be defined by a line connecting a pair of time-serially detected adjacent points and a line connecting a pair of next time-serially detected adjacent points, respectively.

Preferably, the manipulation region of the manipulation means is capable of setting a reference point and a reference axis including the reference point as the origin; and the direction-conversion detecting means includes means for detecting temporal variation of an angle formed between the direction connecting the reference point to a position of performance manipulation within the manipulation region and the reference axis.

Preferably, the musical tone effect control is one of "vibrator", "tremolo", "céleste", and "chorus".

By using the manipulation means for defining a manipulation region of at least two dimensions and for achieving performance manipulation within the manipulation region, time-series position data can be obtained. By detecting direction-change data from a locus of the position data, control parameters other than parameters such as speed, pressure, etc. can be generated newly. These parameters can be utilized for generating musical tones of a rubbed string instrument or a wind instrument.

For example, the direction-change data can be utilized for controlling the "vibrato" effect in a rubbed string instrument or a wind instrument. When, for example, "vibrato" effect is controlled by utilizing the direction change calculated from three time-series points, there arises an operational advantage in that the relations of the motion of the finger and the tone, the degree of vibration of reed, etc. can be grasped sensibly. Accordingly, the "vibrato" effect can be added easily even if the player is not so skilled in playing a rubbed string instrument or a wind instrument.

New control parameters derived from the direction change can also be used for controlling desired effects other then "vibrato", such as "tremolo", "céleste", "chorus", etc.

Further, the aforementioned functions can be selected by a changeover switch, by which the player skilled in the playing technique can play the instrument by the desired execution style.

BRIEF DESCRIPTION OF THE DRAWINGS

FIGS. 4A and 4B illustrate the characteristics of the non-linear circuit, in which FIG. 4A is a graph showing the functions of the division circuit 54 and the multiplication circuit 56 for altering the characteristics of the non-linear circuit 55, and FIG. 4B is a graph showing the hysteresis characteristic given by a feedback loop;

DESCRIPTION OF THE PREFERRED EMBODIMENTS

The present invention will be described below, as to the case of addition of "vibrato" effect in a keyboard type electronic musical instrument for simulating a rubbed string instrument.

Figure 1:
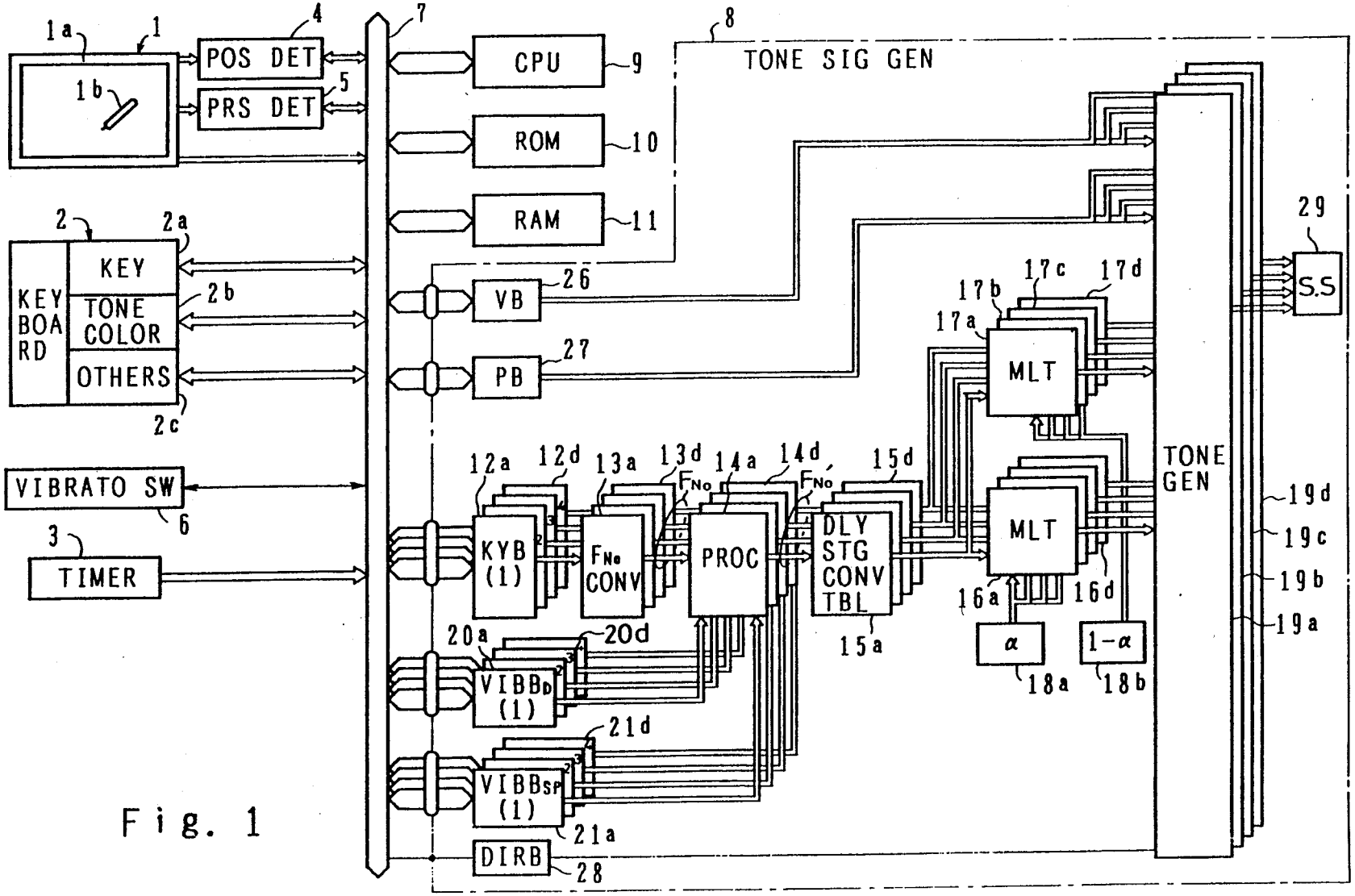
FIG. 1 is a block diagram showing a hardware structure of an electronic musical instrument.

FIG. 1 shows a hardware structure of an electronic musical instrument according to an embodiment of the present invention. A plane manipulator 1 is composed of a flat plane-shaped manipulation region (tablet or means to be manipulated) 1*a*, and a pen-shaped movable hand manipulator 1*b*. The plane manipulator 1 is operated by manipulating the hand manipulator 1*b* on the manipulation region 1*a*. The plane manipulator 1 has a function of detecting the position in the manipulation region designated by the hand manipulator 1*b* and a pressure given by the hand manipulator 1*b*, such as the position where the pen point makes contact and the pressure which the pen point gives, etc. The coordinate information in the manipulation plane 1*a* of the contact point of the hand manipulator 1*b*, the pressure information of the force by which the hand manipulator 1*b* is depressed on the manipulation plane 1*a*, etc. are supplied to a data bus 7 through a coordinate detector (POS DET) 4, a pressure detector (PRS DET) 5, etc. Parameters such as speed information, direction information, locus direction change information, etc. may be generated from the coordinate information by arithmetic operations. The speed information may be used as bow speed information representing the bow manipulation speed. The direction information may be used as information representing the direction (upward, or downward, i.e. up-bow, or down-bow) of motion of the bow of the violin, etc. The pressure information may be used as bow pressure information representing the pressure of the string pressing bow. A keyboard 2 includes a number of keys 2*a* for designating pitches, tone color pads 2*b* for designating tone colors by the names of the musical instruments, etc. and other manipulators 2*c* for designating other functions. The keyboard 2 supplies the respective information to the bus 7. A timer 3 supplies the timing information for issuing the timer interrupt to the bus 7.

A "vibrato" switch 6 is a changeover switch for selecting whether the "vibrato" effect is to be given or not to be given, on the basis of the direction change calculated from the locus of the position of performance manipulation on the plane manipulator 1 by arithmetic operations.

Further, a CPU 9 for performing predetermined arithmetic operations, an ROM 10 for storing the program to be executed in the CPU, etc., an RAM 11 including various kinds of registers and work memories, etc. for storing various kinds of temporary information to be used for executing the program, a tone signal generating circuit (TONE SIG GEN) 8, etc. are connected to the bus 7.

Here, the ROM 10 stores a program for generating musical tones, and the CPU 9 performs the musical tone synthesizing processing according to the program while utilizing the registers in the RAM 11, etc.

The pitch information given by manipulating a key 2*a* of the keyboard 2 is stored in key buffers (KYB) 12*a*, 12*b*, 12*c* and 12*d*. Here, four key buffers are provided correspondingly to the four strings of a rubbed string instrument such as a violin or a viola. The data stored in the key buffers 12*a* to 12*d* includes the most significant bit (MSB) representing the on/off of the key and remaining bits of the key data representing the selected key. Frequency number conversion circuits (FNo CONV) 13*a* to 13*d* generate an F number signal FNo representing the frequency of the musical tone, on the basis of the key data. The F number signal is subjected to "vibrato" treatment by arithmetic operation means (ARITH OP) 14*a* to 14*d* to thereby generate a modified F number signal FNo' of the vibratory frequency data according to the "vibrato" performance.

The tone signal generating circuit 8 includes a velocity information buffer (VB) 26 for storing the velocity information from the bus 7, a pressure information buffer (PB) 27 for storing the pressure information from the bus 7, a direction information buffer (DIRB) 28 for storing the direction information from the bus 7, "vibrato" depth information buffers ($VIBB_D$) 20*a* to 20*d* for storing "vibrato" depth information representing the width of the change of the frequency according to the "vibrato" performance processed by the CPU, and "vibrato" speed information buffers $VIBB_{SP}$ 21*a* to 21*d* for storing "vibrato" speed information representing the number of vibrations in a unit time. The velocity information, the pressure information, the direction information, etc. are supplied to tone generators (TONE GEN) 19*a*, 19*b*, 19*c* and 19*d*. The information pertaining to "vibrato" is supplied to the arithmetic operation means 14*a* to 14*d* to modify the key number information. The pressure information buffer 27 serves as a register for temporarily storing the pressure information obtained from the pressure of the hand manipulator 1*b* against the manipulation plane 1*a*. The direction information buffer DIRB 28 temporarily stores the direction information obtained from the angle change at the position of manipulation, etc.

Figure 2:
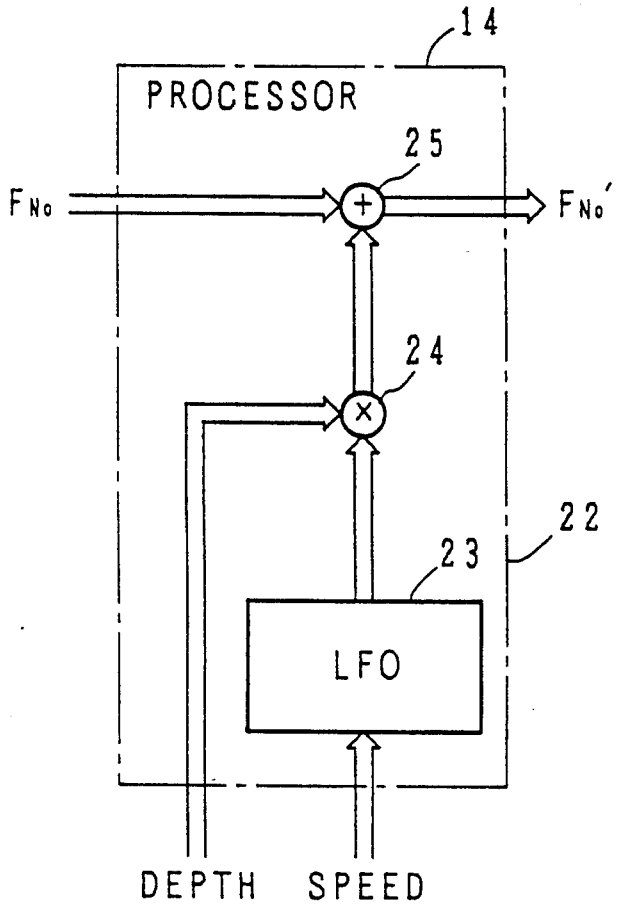
FIG. 2 is a block diagram showing an example of configuration of the arithmetic operation means depicted in FIG. 1.

Each of the arithmetic operation means 14*a* to 14*d* has a configuration as shown in FIG. 2. A low-frequency oscillator (LFO) 23 supplied with the "vibrato" speed information generates a signal of the frequency corresponding to the speed. A multiplier 24 supplied with both the "vibrato" depth information and the output of the low-frequency oscillator 23 generates a signal representing the speed (frequency) information modulated by the depth information. The output signal of the multiplier 24 is added to the F number signal FNo by an adder 25 to generate a modified F number signal FNo'.

As shown in FIG. 1, the modified F number signal thus generated is fed to corresponding delay conversion circuits (DLY CONV) 15*a* to 15*d* and supplied to the tone generators 19*a* to 19*d* through multiplication circuits (MLT) 16*a* to 16*d* and 17*a* to 17*d*. The delay conversion circuits 15*a* to 15*d* decrease the number of stages of delay when pitch is high and increase the number of stages of delay when pitch is low, so that the number (frequency) of circulations of the input signal in a signal loop in the tone generators 19*a* to 19*d*, which will be described later, in a predetermined time is changed to generate a signal of a predetermined frequency. In the multiplication circuits 16*a* to 16*d*, the supplied pitch is multiplied by a predetermined coefficient $\alpha$. In the multiplication circuits 17*a* to 17*d*, the supplied pitch is multiplied by a complementary coefficient $(1-\alpha)$. The two multiplications represent that a string of a rubbed string instrument from the bridge to the depressed finger position on the fingerboard may be considered to be divided into two portions at the position where the bow rubs the string. Namely, the fact that the addition of the two coefficients makes 1 represents the fact that the string length from the depressed finger position to the bridge is the basic length determining the pitch. When one coefficient $\alpha$ corresponds to the distance from the string rubbing position to the bridge, the other coefficient $(1-\alpha)$ will correspond to the distance from the string rubbing position to the depressed finger position. In this way, the information representing the pitch is supplied to the tone generators 19*a* to 19*d*.

Although this embodiment has shown the case where a plurality of tone generators are provided, the invention can be applied to the case where the same effect as that of the plurality of tone generators may be obtained by time-sharing of one tone generator.

If necessary, tone signals are generated in the tone generators 19*a* to 19*d* on the basis on the pitch information including the "vibrato" effect, the velocity information, the pressure information, the direction information, etc. and fed to a sound system 29 to produce musical tones. Here, each of the tone generators 19*a* to 19*d* includes a format filter for simulating the behavior of the belly of the rubbed string instrument. The sound system 29 includes means for converting the digital tone signal into an analog signal, means for amplifying the analog signal, and means for transforming the electric signal into an acoustic signal.

In this way, musical tones of a rubbed string instrument or a wind instrument which can vary its expression in a variety of ways in accordance with the bow speed, the bow pressure, the direction of motion of the bow, etc. with the addition of "vibrato" effect can be generated.

Now, among the registers provided in the RAM, major ones will be explained hereinbelow.

"Vibrato" Mode Register (VIB)

This is a register for storing data representing information pertaining "vibrato" information generating mode which is changed over by the "vibrato" switch 6. When the mode data is "1", "vibrato" effect addition information which will be described later is generated on the basis of the direction change in a unit time and given to the tone signal generating circuit 8.

Event Buffer Register (EVTBUF)

This is a register for storing key event data corresponding to key depression and key release of a key 2*a* in the keyboard. The key event data includes an on/off data and a key code data representing the pitch. In the case of a rubbed string instrument, four event buffer registers are provided to enable four key events to be stored, considering the case where four strings are performed simultaneously. These registers play the role of storing the pitch data temporarily.

Present X Position Register (X)

This is a register for storing the X directional position $X_p$ of the present manipulation position of the hand performance manipulator 1*b* in the tablet 1*a* which forms a plane for receiving manipulation.

Previous X Position Register ($X_n$)

This is a register for storing the X directional position $X_n$ of the hand performance manipulator 1*b* at the time of previous timer interrupt. Here, the transition distance in the X direction can be calculated from the two values of the X directional positions $X_p$ and $X_n$ at the present and previous timer interrupts.

Present Y Position Register (Y)

This is a register for storing the Y directional position $y_p$ of the present manipulation position of the hand performance manipulator 1*b* in the tablet 1*a*.

Previous Y Position Register ($y_n$)

This is a register for storing the Y directional position $y_n$ of the hand performance manipulator 1*b* at the time of previous timer interrupt. Here, the transition distance in the Y direction can be calculated from the two values of the Y directional positions $y_p$ and $y_n$ at the present and previous timer interrupts.

Velocity Register (V)

This is a register for storing the velocity information representing the bow speed. The velocity information is derived from the transition distance calculated from the X directional transition distance and the Y directional transition distance as described above (and by driving it by time).

Pressure Register (P)

This is an RAM-side register for storing the pressure data derived from the output $P_0$ of a pressure sensor provided in the plane manipulator 1.

Present Angle Register ($\theta_p$)

This is a register for storing angle data calculated by arithmetic operations from the position of performance manipulation with respect to the center ($X_c$, $X_y$) of the plane manipulator 1.

Previous Angle Register ($\theta_n$)

This is a register for storing angle data at the time of the previous timer interrupt.

Direction Register (dir)

This is a register for storing direction data calculated by arithmetic operations from the variation of the angle data. The direction data represents the direction of movement of the bow (upward direction or downward direction). In the tone signal generating circuit 8, there are also provided a velocity buffer VB, a pressure buffer PB, a direction buffer DIRB, etc.

Advancing Direction Change Register ($\omega$)

This is a register for storing information representing the change of the proceed direction of the locus of performance manipulation in a unit time. This data is used as new information for controlling the effect such as "vibrato" effect.

"Vibrato" Depth Register ($VIB_D$)

This is a register for storing the "vibrato" depth information representing the pitch size of vibration.

"Vibrato" Speed Register ($VIB_{SP}$)

This is a register for storing the "vibrato" speed information representing the number of vibrations in a unit time.

Flag OLD Register

This is a register for storing "1" or "0" indicating whether the flag OLD is set or reset. If this flag is set to "1", it means that the phenomenon represented by this flag has been already detected and this is the timer interrupt on and after the second time.

Also, there are provided other registers for storing various constants and variables, but the description thereof is omitted here for the sake of simplicity.

Figure 3:
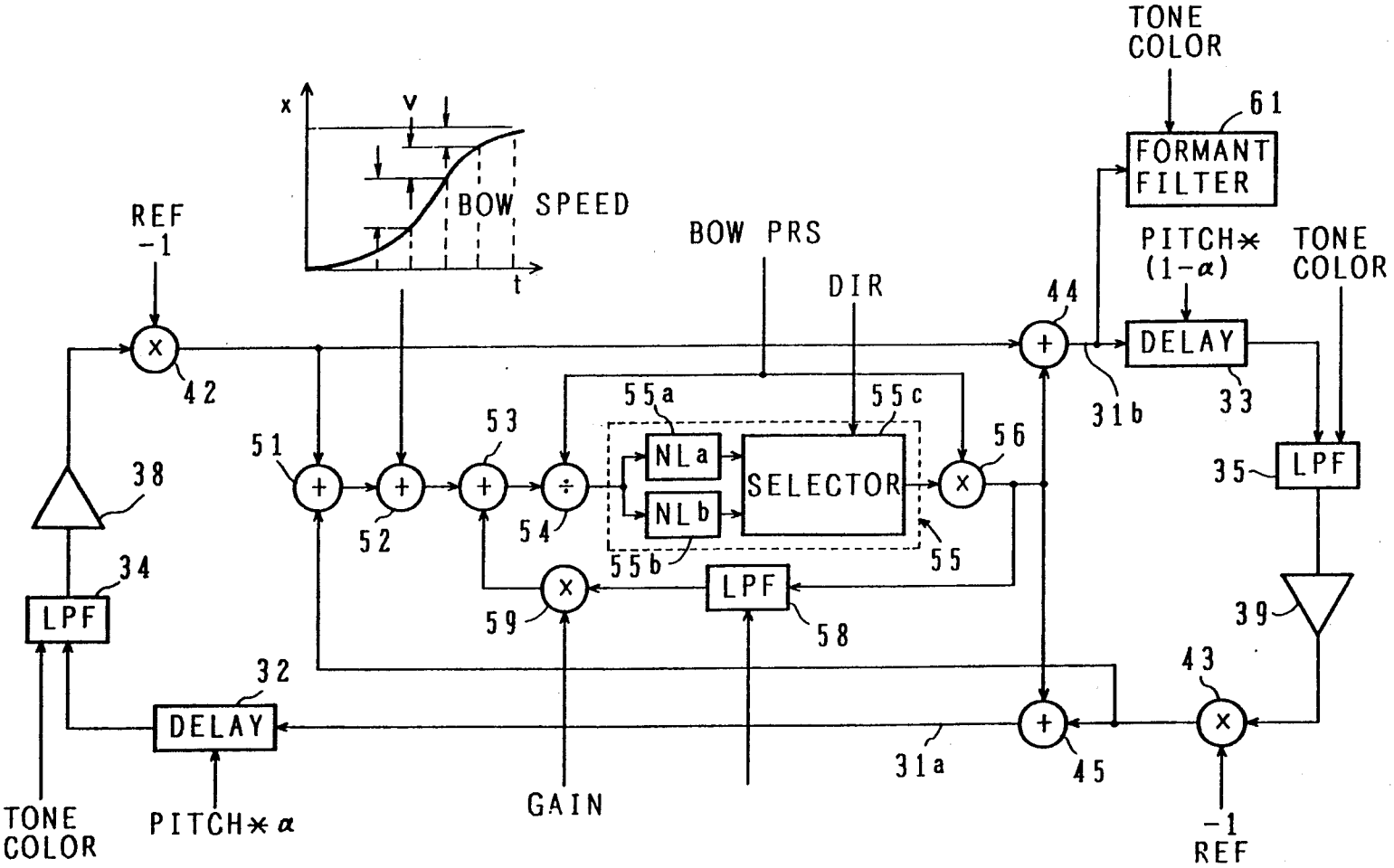
FIG. 3 is a circuit diagram showing a main part of a tone signal generating circuit provided in the electronic musical instrument of FIG. 1.

FIG. 3 is an equivalent circuit block diagram showing a main part of a tone signal generating circuit 8 which constitutes a tone generator model suitable for a rubbed string instrument. Corresponding to the rubbing action of a bow on a string of a rubbed string instrument, a bow speed signal is generated and fed into an addition circuit 52. This bow speed signal is a starting signal and supplied to a non-linear circuit 55 through an addition circuit 53 and a division circuit 54. The non-linear circuit 55 is a circuit for representing the non-linear characteristic of a string of the violin. The non-linear circuit 55 includes a first non-linear circuit (NLa) **55*a* which represents the characteristic when the bow is moving downward, a second non-linear circuit (NLb) 55*b* which represents the characteristic when the bow is moving upward, and a selector circuit 55*c* for selecting one of the output signals of the two non-linear circuits. The selector circuit 55*c*** is controlled by the direction signal.

Figure 4A:
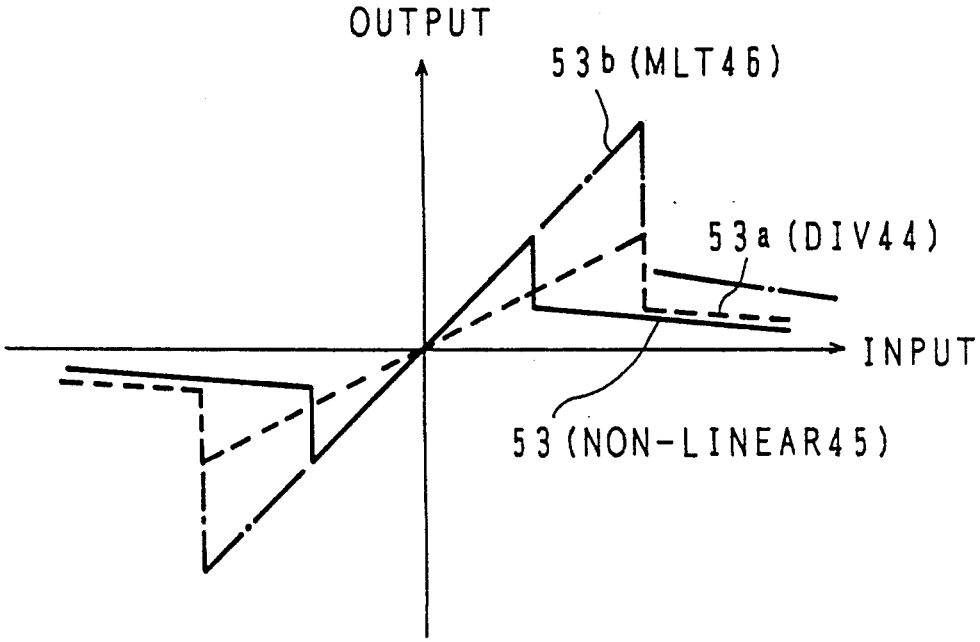

The non-linear characteristics of the non-linear circuits **55*a* and 55*b* include, as is generically represented by the reference numeral 63 in FIG. 4A, a substantially linear region from the origin to certain points, and outer regions of changed characteristic. When the string of a rubbed string instrument such as a violin is rubbed by the bow, as long as the bow speed is slow, the displacement of the string is substantially equivalent to the displacement of the bow so that the movement of the string can be represented by the term of the static friction coefficient. This phenomenon can be represented by the substantially linear characteristic region containing the origin as its center. When the speed of the bow relative to the string exceeds a certain value, the speed of the bow and the displacement speed of the string are no longer the same. Namely, the movement is determined by a dynamic friction coefficient, in place of the static friction coefficient. This changeover from the static friction coefficient to the dynamic friction coefficient is represented by the step portion in FIG. 4A**.

In FIG. 3, the output of the non-linear circuit 55 is supplied to two addition circuits 44 and 45 through a multiplication circuit 56.

The division circuit 54 on the input side and the multiplication circuit 56 on the output side of the non-linear circuit 55 receive the bow pressure signal and alter the characteristic of the non-linear circuit 55. The division circuit 54 on the input side changes the input signal to a smaller value by dividing it. Namely, as shown by the broken line **63*a* of FIG. 4A, when the division circuit 54 is connected, even when a large input is applied, an output as if the input was small is generated. The multiplication circuit 56 on the output side plays the role of increasing the output of the non-linear circuit 55. Namely, the multiplication circuit 56 increases the characteristic 63*a* produced by the division circuit 54 and the non-linear circuit 55 to a larger value of the output to produce a new characteristic as shown by the dot-and-dash line 63*b* of FIG. 4A. Here, upon the same bow pressure signal, first dividing the input and finally multiplying the output represents dividing a characteristic by a coefficient $C_0$ in the division circuit 54 and multiplying the result by the same coefficient $C_0$ in the multiplication circuit 56. In this case, the total characteristic 63*b* of the dot-and-dash line lies on the extension of the characteristic 63 produced solely by the non-linear circuit 55**, and has a shape which is multiplied by $C_0$ both in the abscissa and in the ordinate. It is also possible to differentiate the coefficient of the multiplication circuit from the coefficient of the division circuit, to form a different shape.

The addition circuits 44 and 45 are provided in half-circulating signal paths **31*a* and 31*b*. A circulating signal path constituted by the half-circulating signal paths 31*a* and 31*b* forms a closed loop for circulating the tone signal corresponding to the string of the rubbed string instrument. Namely, in the case of a string, the vibration is reflected at the opposite ends of the string and moves back and forth. In the case of a wind instrument, the vibration moves back and forth in its resonance body. This behavior is approximated by the closed loop in which a signal circulates. The circulating signal path includes two delay circuits 32 and 33, two low-pass filters (LPF) 24 and 25, two decay circuits 38 and 39, and two multiplication circuits 42 and 43. The delay circuits 32 and 33** are supplied with the products of the pitch signal representing the pitch and the coefficients $\alpha$ and $(1-\alpha)$ respectively so as to provide a predetermined delay time.

When the "vibrato" effect is given, the pitch is controlled by the arithmetic operation circuit 14 as shown in FIG. 2 so as to vibrate with the passage of time.

The total delay time required for returning a signal to its original position by circulation in the circulating signal paths **31*a* and 31*b* determines the basic pitch of the musical tone. Namely, the sum of the delay times of the two delay circuits 32 and 33**, pitch$\times[\alpha+(1-\alpha)]$=pitch, determines the basic pitch. One delay circuit corresponds to the distance from the position where the bow touches the string to the bridge, and the other delay circuit corresponds to the distance from the position where the bow touches the string to the depressed finger position.

Although the pitch is mainly determined by the delay circuits 32 and 33, other factors included in the circulating signal path such as LPFs 34 and 35, the decay controls 38 and 39, etc. also can produce delays. Strictly, the pitch of the musical tone to be generated is determined by the sum of all delay times included in the loop.

The LPFs 34 and 35 simulate the vibration characteristics of various strings by altering the transmission characteristics of the circulating waveform signal. A tone color signal is generated by selecting a tone color pad **2*b* on the keyboard, etc. and supplied to the LPFs 34 and 35** to change over the characteristic to simulate the musical tone of the desired rubbed string instrument.

While the vibration propagates on the string, the vibration decays gradually. The decay controls 38 and 39 simulate the quantity of the decay of the vibration propagating on the string.

The multiplication circuits 42 and 43 multiply the input signal by the reflection coefficient $-1$ correspondingly to the reflection of the vibration at fixed ends of the string. Namely, assuming the reflection at the fixed ends without decay, the amplitude of the string is changed to the opposite phase. The coefficient $-1$ represents this opposite phase reflection. The decay of the amplitude caused by the reflection is incorporated in the quantity of decay in the decay controls 38 and 39.

In this way, the motion of the string of the rubbed string instrument is simulated by the vibration circulating on the circulating signal paths **31*a* and 31*b*** which correspond to the string.

Further, the motion of the string of the rubbed string instrument has hysteresis characteristic. For simulating this hysteresis characteristic, the output of the multiplication circuit 56 is fed back to the input of the non-linear circuit 55 through the LPF 58 and the multiplication circuit 59. The LPF 58 serves to prevent oscillation in the feedback loop.

Let the input from the addition circuit 52 to the addition circuit 53 be u, the input from the feedback path to the addition circuit 53 be v, and the amplification factor of the division circuit 54, the non-linear circuit 55 and the multiplication circuit 56 in total be A. Then the output w of the multiplication circuit 56 can be expressed by $(u+v)A=w$. Let the gain of the negative feedback loop including the LPF 58 and the multiplication circuit 59 be B (negative value), then the amount of feedback v can be represented by $v=wB$. Arranging these two equations, $$(u+wB)A=w$$

$$\text{therefore, } w=uA/(1-AB)$$

In the case of no feedback, i.e. $B=0$, the output w can be simply expressed by $w=uA$, which means that the input u is simply multiplied by a factor A and then sent out. In the case of negative feedback of a gain B, an input $(1-AB)$ times (B is negative) as large as the input in the case of $B=0$ should be applied to obtain an output of the same magnitude.

Figure 4B:
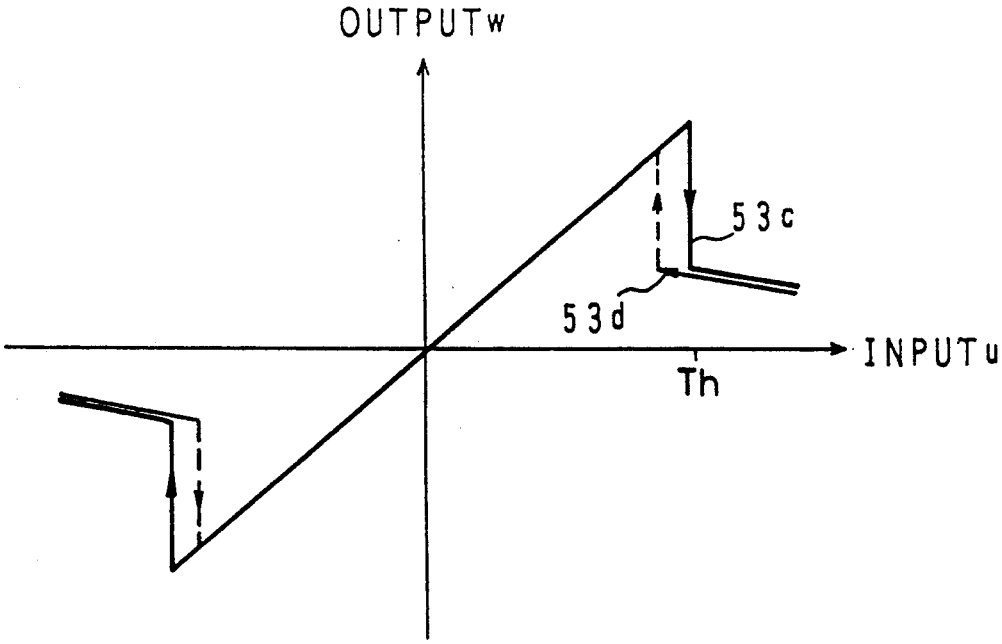

The characteristic when the input is increasing and there is such feedback is represented by the curve 63c in FIG. 4B. When the input increases to a certain value, there occurs changeover from the static friction coefficient to the dynamic friction coefficient, so that the output decreases stepwise. This input threshold value is represented by $Th_1$.

When the input has once exceeded the threshold value $Th_1$ and then decreases to a smaller value again, the output w is small and hence the feedback amount $v=Bw$ is also small. Namely, even if the magnitude of the signal supplied into the non-linear circuit 55 is the same, the negative feedback amount is relatively small in the case of the dynamic friction coefficient region, compared with the case of the static friction coefficient region, so that the input u from the addition circuit 52 to the addition circuit 53 takes a smaller value.

Consider now the magnitude of the input u from the addition circuit 52 when the input to the non-linear circuit 55 becomes the threshold value. When the input is increasing, the static friction coefficient dominates the motion. Accordingly, a strong negative feedback is applied corresponding to a large output, so that the changeover occurs at a larger input $Th_1$. On the contrary, when the input is decreasing, the dynamic friction coefficient dominates the motion. Accordingly, the negative feedback is small corresponding to a small output, so that the changeover occurs at a smaller input u than $Th_1$. Therefore, the relation between the input u and the output w when the input is gradually increasing and when the input is gradually decreasing can be represented by the curves 63c and 63d of FIG. 4B as a hysteresis characteristic. The magnitude of hysteresis is controlled by the gain of the multiplication circuit 59.

In this way, according to the tone signal generating circuit as shown in FIG. 3, the motion of the string of the rubbed string instrument can be simulated, so that a basic waveform of the musical tone can be produced.

An output is derived from some point in the circulating signal path 31 as shown in FIG. 3 and is supplied to the sound system through the formant filter 61 which simulates the characteristic of the belly of the rubbed string instrument. The formant filter 61 may be arranged to vary its characteristic upon reception of a tone color signal.

In the tone signal generating circuit shown in FIG. 3, the signal having motive power for generating the musical tone is given by the bow speed. In the case of "vibrato" performance, a vibrating pitch signal is given. Further, the pressure signal is used as a signal for controlling the characteristic of the non-linear circuit 55. Further, the characteristic of the non-linear circuit 55 itself is controlled by the direction of the movement of the bow. It is preferable that these parameters are controllable based on the player's will or the performance manipulation of the player. The parameter for designating the pitch can be derived by manipulating a key 2a in the keyboard 2 or by the arithmetic operations in the CPU 9 and the arithmetic operation means 14, etc. on the basis of the performance manipulation of the plane manipulator 1 in particular in the case of addition of the "vibrato" effect. The bow speed information, the bow pressure information and the direction information can be obtained by the performance manipulation of the performance manipulator in the plane manipulator 1. For example, the plane manipulator 1 includes a tablet 1a and a hand manipulator 1b.

Figure 5A:
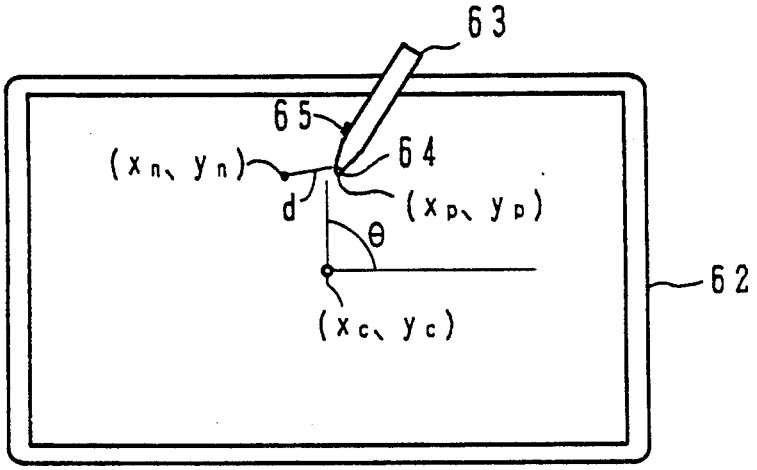
FIGS. 5A and 5B are schematic diagrams for illustrating an example of the configuration and the function of the performance manipulator.
Figure 5B:
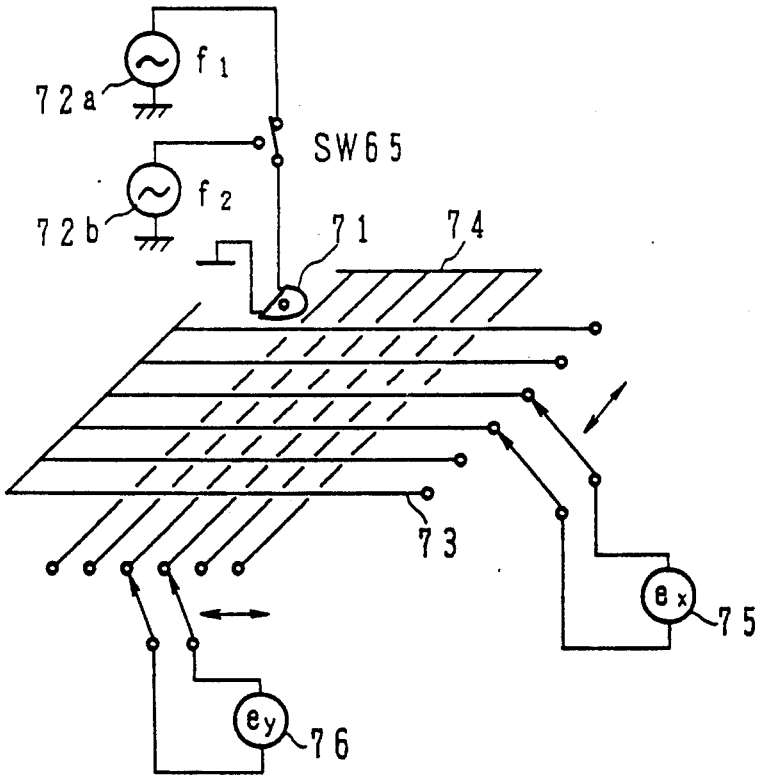

FIGS. 5A and 5B show an example of construction of the plane manipulator.

FIG. 5A is a schematic plan view showing a configuration for manipulating the plane manipulator. A tablet 62 has a manipulation plane capable of detecting the relative position in the plane. The pen manipulator 63 to be used in combination with the tablet 62 has a pen point 64 which is to be manipulated by displacement over the surface while touching the tablet 62, and also has a switch 65. Further, a reference point having coordinates $(x_c, y_c)$ is set in the manipulation plane of the tablet 62. Also, a reference axis direction is set as a direction passing through the reference point. By the performance manipulation of the pen manipulator 63 in the manipulation plane of the tablet 62, the speed information and the direction information are generated from the movement distance d and the change of the angle $\theta$ with respect to the reference axis direction, respectively, as will be described later.

An example of the electric circuit to be incorporated in such a plane manipulator is shown in FIG. 5B.

FIG. 5B shows an electromagnetic induction type position detecting plane manipulator. The pen manipulator has an AC power source 72a of a frequency $f_1$, another AC power source 72b of a frequency $f_2$, a coil 71 and a switch SW 65. The pen manipulator generates an AC magnetic field of a frequency $f_1$ or $f_2$, selectively. The AC magnetic field is established in the tablet plane by approaching the coil 71 to the tablet. In the tablet, there are disposed a plurality of X direction detection lines 73 which are arranged in parallel to the X direction and which have one ends commonly connected to each other, and a plurality of Y direction detection lines 74 which are arranged in parallel to the Y direction and which have one ends commonly connected to each other. At open ends of these detection lines, detectors 75 and 76 are connected between adjacent detection lines of X direction and between adjacent detection lines of Y direction, respectively, to be successively scanned. Namely, because an AC magnetic field is produced in the vicinity of the coil 71 of the pen manipulator, a current is induced in the detection lines just under the coil 71. By detecting the induction current in the detectors 75 and 76, the frequency of the AC magnetic field produced in the coil 71 of the pen manipulator and the manipulation position of the pen manipulator are detected. The changeover between the frequency $f_1$ and the frequency $f_2$ represents, for example, the changeover between what is called "arco" style rendition (i.e. bowing) and "pizzicato" style rendition. The information of the manipulation position produces speed information, direction information and "vibrato" information by the following processings. Here, the pressure of the manipulation is detected by a pressure sensor such as a pressure sensitive conductive sheet provided under the position detection means.

When the pen point 64 of the manipulator 63 is moved while touching the manipulation plane, the position of manipulation is detected successively in time sequence according to the timer interrupt. Assuming now that the present position of the pen point 64 and the previous position at the previous timer interrupt are respectively represented by $(x_p, y_p)$ and $(x_n, y_n)$, then the distance d from the previous position to the present position is calculated. Further, a reference axis is established from the reference point $(x_c, y_c)$ to the rightward direction as shown in FIG. 5A, so that the angle $\theta$ between the line connecting the reference point $(x_c, y_c)$ and the manipulation point $(x_p, y_p)$ to each other and the reference axis is calculated. The direction of the angle change is derived from the difference between the present angle data $\theta_p$ at the present timer interrupt and the previous angle data $\theta_n$ at the time of the previous timer interrupt. These parameters can form velocity information, pressure information and direction information.

When the hand manipulator 1*b* is manipulated in the manipulation plane 1*a* while the "vibrato" switch 6 in FIG. 1 is on, direction-change information is extracted from the locus of the hand manipulator 1*b*.

Figure 6:
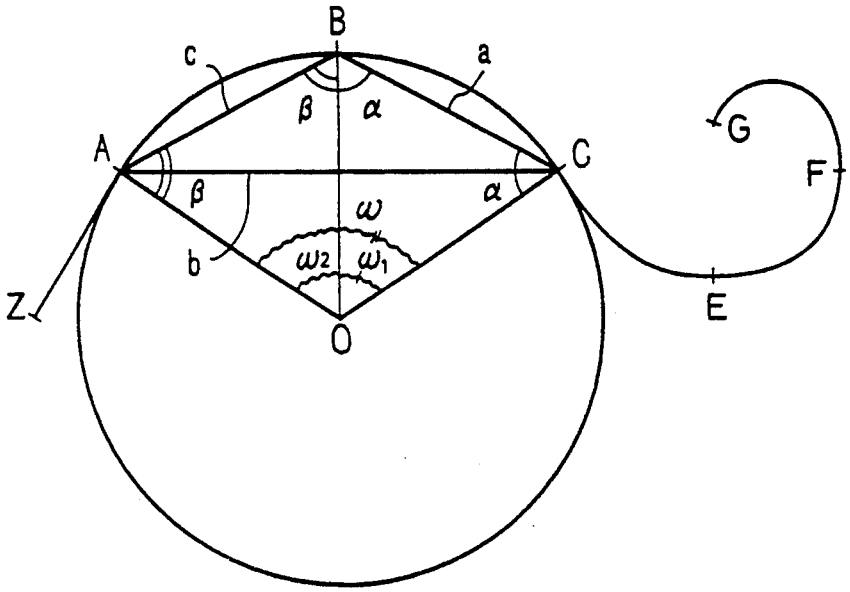
FIGS. 6, 7A and 7B are diagrams for illustrating the techniques of deriving direction-change data from a locus of performance manipulation.

An example of technique for picking out the direction-change information is shown in FIG. 6. How consider the case where the top end of the hand manipulator moves from a point Z to a point G via points A, B, C, E and F in the pin the manipulation plane. In this case, direction-change information is extracted from adjacent three sampling points. Let the points A, B and C be three time-series points detected successively. Now consider a circle circumscribed with a triangle ABC determined by the three points A, B and C. Let the center of the circle be O. The direction change in the movement of the manipulation position from the point A to the point C is represented by an angle $\omega$ between a radius OA connecting the points O and A and a radius OC connecting the points O and C. Now consider a radius OB in order to calculate the angle $\omega$ of the direction change.

At a triangle OBC, $$\omega_1+2\alpha=\pi \tag{1}$$

At a triangle OAB, $$\omega_2+2\beta=\pi \tag{2}$$

$$\omega_1+\omega_2=\omega \tag{3}$$

Arranging these equations (1) to (3), $$\omega+2(\alpha+\beta)=2\pi \tag{4}$$

Accordingly, $\alpha+\beta=\pi-(\omega/2)$.

From the second law of cosines with respect to the triangle ABC, $$\begin{aligned} b^2 &= c^2+a^2-2ca\cdot\cos(\alpha+\beta) \\ &= c^2+a^2-2ca\cdot\cos[\pi-(\omega/2)] \\ &= c^2+a^2-2ca\cdot[\cos(\omega/2)] \end{aligned} \tag{5}$$

From the equation (5), $$\cos(\omega/2)=(b^2-C^2-a^2)/2ca$$

$$\therefore\omega=2\cos^{-1}\{(b^2-c^2-a^2)/2ca\} \tag{6}$$

In the equation (6), $$a=\{(X_3-X_2)^2+(Y_3-Y_2)^2\}^{\frac{1}{2}} \tag{7}$$
$$b=\{(X_3-X_1)^2+(Y_3-Y_1)^2\}^{\frac{1}{2}} \tag{8}$$
$$c=\{(X_2-X_1)^2+(Y_2-Y_1)^2\}^{\frac{1}{2}} \tag{9}$$

Substituting the equations (7) to (9) into the equation (6), $$\begin{aligned}\omega = 2\cos^{-1}[&\{(X_3-X_2)^2+(Y_3-Y_2)^2- \\ &(X_3-X_1)^2-(Y_3-Y_1)^2- \\ &(X_2-X_1)^2-(Y_2-Y_1)^2\}/ \\ &2\{(X_3-X_2)^2+(Y_3-Y_2)^2\}^{\frac{1}{2}}\cdot \\ &\{(X_2-X_1)^2+(Y_2-Y_1)^2\}^{\frac{1}{2}}]\end{aligned}$$

Thus, the angle $\omega$ of the direction change can be calculated.

Figure 7A:
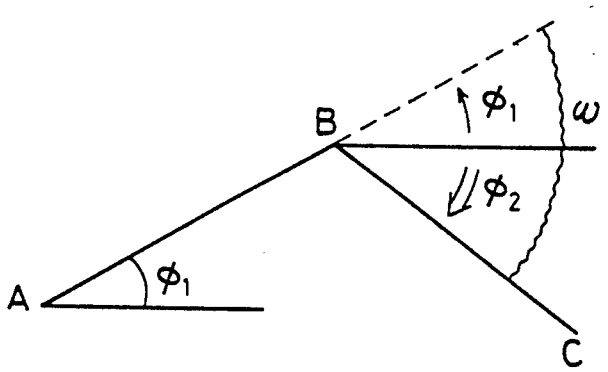
Figure 7B:
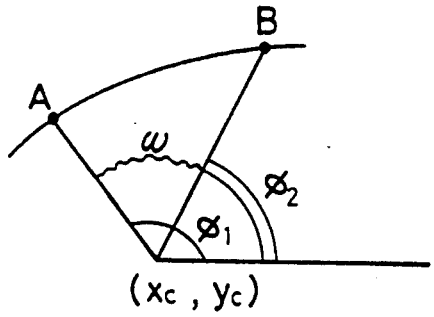

The change of the proceed direction may be calculated by other methods. FIGS. 7A and 7B show the case where the change of the proceed direction of the hand manipulator is calculated by other methods.

FIG. 7A shows the case where the change of the proceed direction is calculated from three time-series points A, B and C detected successively. A reference direction (represented by the horizontal direction in this embodiment) is first assumed to obtain angles between the reference direction and segments connecting the adjacent points in time sequence. Namely, in the case where three points A, B and C are detected successively in time sequence, segments AB and BC are assumed now. Let the angle between the segment AB and the reference axis be $\phi_1$. Let the angle between the segment BC and the reference axis be $\phi_2$ (in FIG. 7A, $\phi_2$ has a negative value). Then, the value of direction change of the hand manipulator moving from the point A to the point C is calculated by the equation:

$$\omega=\phi_2-\phi_1$$

$$=-(\phi_1-\phi_2)$$

in which the angles $\phi_1$ and $\phi_2$ are expressed by the following equations.

$$\phi_1=\tan^{-1}\{(Y_2-Y_1)/(X_2-X_1)\}$$

$$\phi_2=\tan^{-1}\{(Y_3-Y_2)/(X_3-X_2)\}$$

Although the angle of the directing change can be detected by detecting such three points in time sequence, the angle of the direction change may be calculated by another method using two time-series points and a preliminarily established reference point $(x_c, y_c)$.

FIG. 7B shows the case where the value of the direction change is calculated from data of two points. Consider now two points A and B detected in time sequence. Let angles for the points A and B with respect to a reference axis (represented as a horizontal direction in FIG. 7B) containing a reference point be $\phi_1$ and $\phi_2$, respectively. Let the coordinates of the reference point be $(x_c, y_c)$.

The angle $\phi_1$ for the point A is represented by the following equation.

$$\phi_1 = \tan^{-1}\{(Y_1 - y_c)/(X_1 - x_c)\}$$

The angle $\phi_2$ for the point B is represented by the following equation.

$$\phi_2 = \tan^{-1}\{(Y_2 - y_c)/(X_2 - x_c)\}$$

The value of the change of the proceed direction is calculated as follows.

$$\omega = \phi_2 - \phi_1$$

From the direction-change information thus calculated, information for controlling the "vibrato" depth and the "vibrato" speed is derived.

Figure 8A:
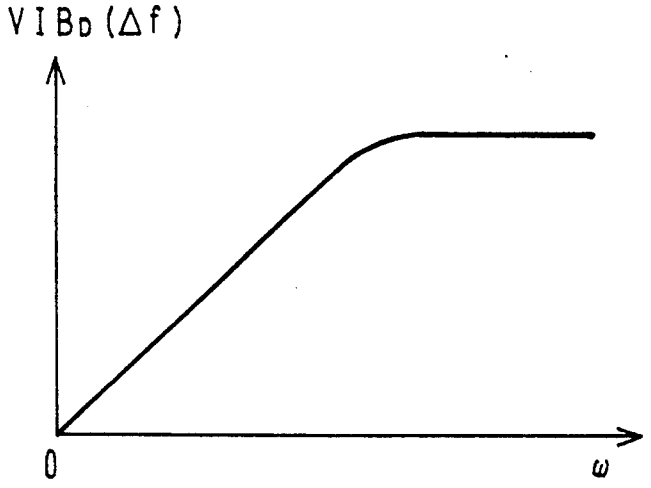
FIGS. 8A and 8B are graphs for illustrating the generation of "vibrato" information from a direction-change table.
Figure 8B:
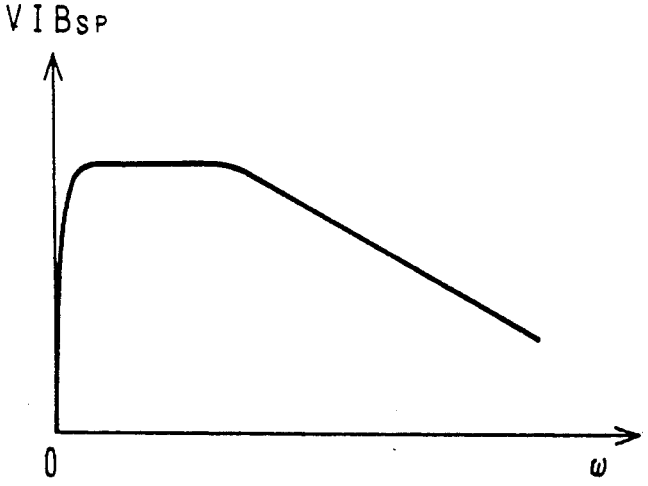

For example, the angle $\omega$ of the direction change obtained as described above is transformed into the "vibrato" depth $VIB_D$ and the "vibrato" speed $VIB_{SP}$ as shown in FIGS. 8A and 8B.

In FIG. 8A, the "vibrato" depth increases as the angle $\omega$ of the direction change increases. The "vibrato" depth is saturated finally. This phenomenon means that the "vibrato" depth increases with the increase of the angle change $\omega$ according to the player's will. Further, the "vibrato" depth is saturated at a certain point to make the characteristic flat to prevent the unpleasant feeling caused by the excessively deep "vibrato".

In FIG. 8B, the "vibrato" speed $VIB_{SP}$ is established to obtain "vibrato" having a substantially constant period ("vibrato" speed), in the case where "vibrato" is to be used according to the player's will. In general, in the case of the natural string instrument, as the "vibrato" depth increases, the width of motion of the finger on the fingerboard increases and, naturally, the period of vibration becomes longer. Therefore, the characteristic of the "vibrato" speed is established so that $VIB_{SP}$ decreases when $\omega$ exceeds a certain value.

In this way, the information pertaining to "vibrato" such as the "vibrato" depth and the "vibrato" speed can be produced by detecting the angle change of the performance manipulation of the hand manipulator.

In the following, a flow chart of musical tone generation in the case of performing a rubber string instrument by utilizing a structure as described above is described. It is now assumed that the "vibrato" switch 6 for selecting the mode of the "vibrato" information detection is a circulating type switch in which two states appear alternately and repeatedly upon manipulation.

Figure 9:
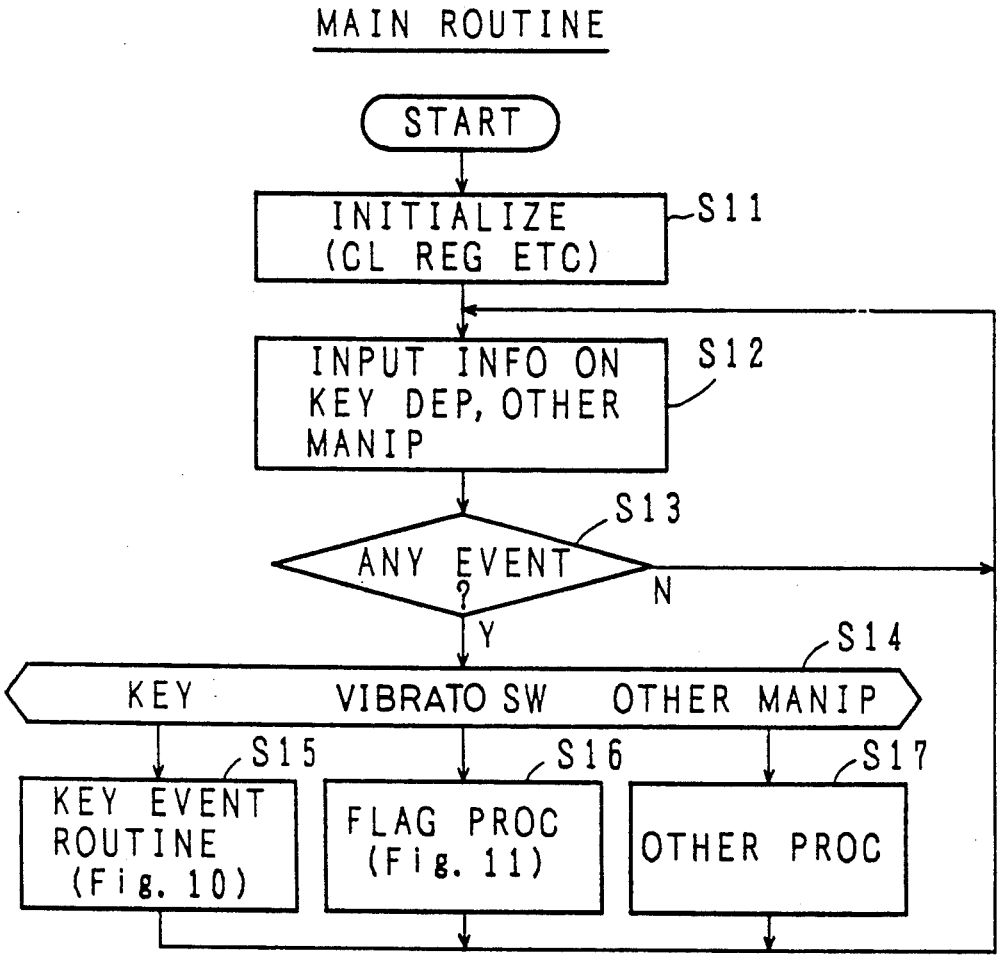
FIG. 9 is a flow chart of the main routine.

First, the main routine is shown in FIG. 9. When the main routine is started, initialization is done in the step S11. For example, the respective registers are cleared. In the next step S12, the information of key depression and key release in the keyboard and the information on the manipulation of the respective manipulators such as plane manipulator, etc. are detected and inputted.

When the performance manipulation information is inputted, a judgment is made as to whether any event or events have occurred or not, in the step S13.

If there is an event, the flow goes to the step S14. In the step S14, judgments are made as to whether there is a key event or not, whether the "vibrato" switch is operated or not, and whether other manipulators are manipulated or not. If there is a key event, the flow goes to the key event routine of the step S15. When the "vibrato" switch is operated, the flag processing of the step S16 is done. Also, when any one of the other manipulators is manipulated, the corresponding processing is done in the step S17.

Figure 10:
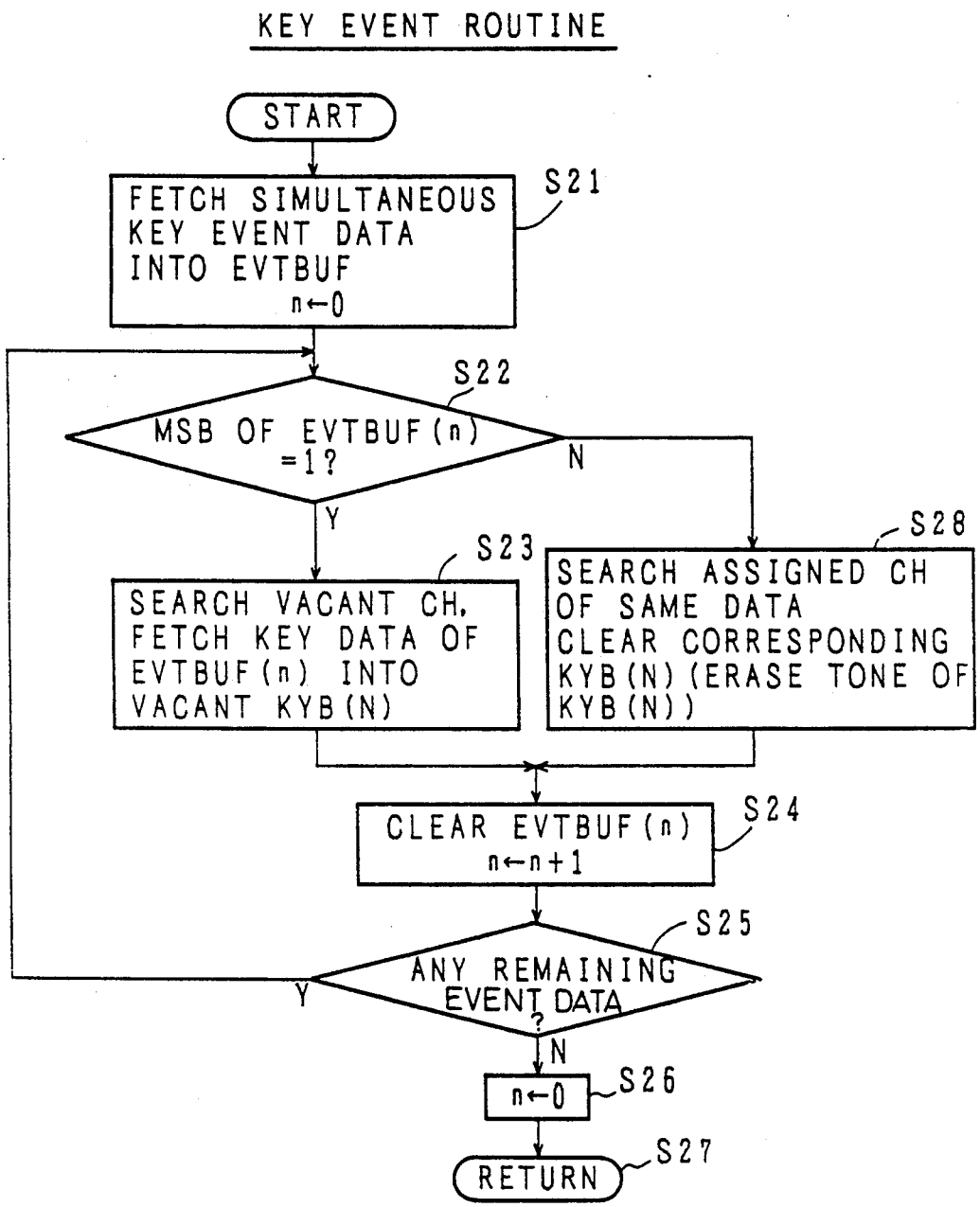
FIG. 10 is a flow chart of the key event routine.

FIG. 10 shows the key event routine. When the key event routine is started, in the step S21, data of key events which have occurred simultaneously are fetched into event buffer registers EVTBUF and "0" is set in the number n.

In the next step S22, a judgment is made as to whether the MSB of the n-th (first 0-th) event buffer register EVTBUF(n) is "1" or not. The fact that the MSB is "1" indicates a depressed key state in which a key is depressed. The fact that the MSB is "0" indicates a released key state. If the MSB is "1", the flow goes to the next step S23 along the arrow Y.

In the step S23, the key data of the event buffer register EVTBUF(n) is fetched into a vacant key buffer KYB(N) after searching vacant channels for inputting the depressed key data.

In this embodiment, when there is no vacant channel, channel assignment will not be done. However, the depressed key data may be rewritten successively in the oldest assigned channel while searching out the assigned channel, as will be described later.

Then, the event buffer register EVTBUF(n) which has fetched the key data is cleared. Then, the number n is counted up by one to n+1 (the step S24).

In the next step S25, a judgment is made as to whether there are remaining event data in the event buffer registers or not. If there is no remaining data, "0" is set in the number n to terminate the processing (the step S26), and the flow returns (the step S27).

When there is any remaining event in the event buffer registers, the flow goes back from the step S25 to the step S22.

In the step S22, if the MSB of the n-th event buffer register is "0", the flow goes to the step S28 and an assigned channel of the same key data is searched for. Namely, MSB="0" means key release. For realizing key release, the key should be depressed beforehand. Therefore, a key buffer storing the depressed key data is searched for. When the assigned channel is searched out, the associated key buffer KYB(N) corresponding to the key release is cleared and the corresponding musical tone is erased.

In this embodiment, for generating a musical tone, it is necessary that any one key in the keyboard is depressed and the hand manipulator touches the manipulation plane in the plane manipulator. In an electronic musical instrument which requires two conditions of key depression and manipulation of the hand manipulator as the condition for generating a tone, the musical tone is erased when the key is released. Clearing of KYB corresponds to the key release.

Here, in the case where an assignment system in which the oldest assigned key data is successively rewritten as will be described later is employed, the processing corresponding to the key release event may be omitted and the manipulation of the pen may be employed as the sole condition for generating the musical tone.

Figure 11:
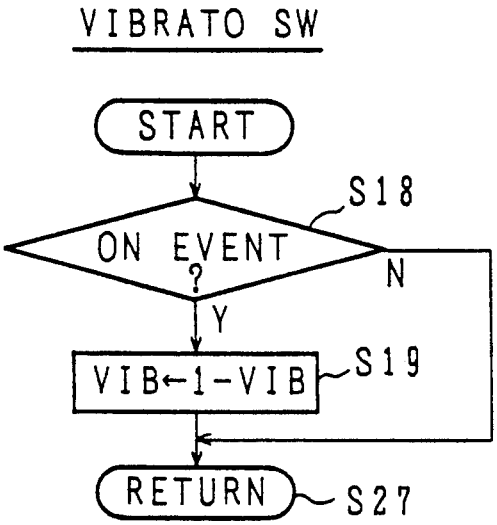
FIG. 11 is a flow chart of the "vibrato" switch routine.

FIG. 11 shows the flag processing routine for the "vibrato" switch. When the "vibrato" switch is operated, a judgment is made as to whether it is an "on" event or not, in the step S18. If it is an "on" event, "1-VIB" is set in the register VIB in the step S19. Namely, the state is inverted. If it is not an on event, the step S19 is skipped over. Then, the flow returns (the step S27) to a state awaiting the next "start".

Figure 12:
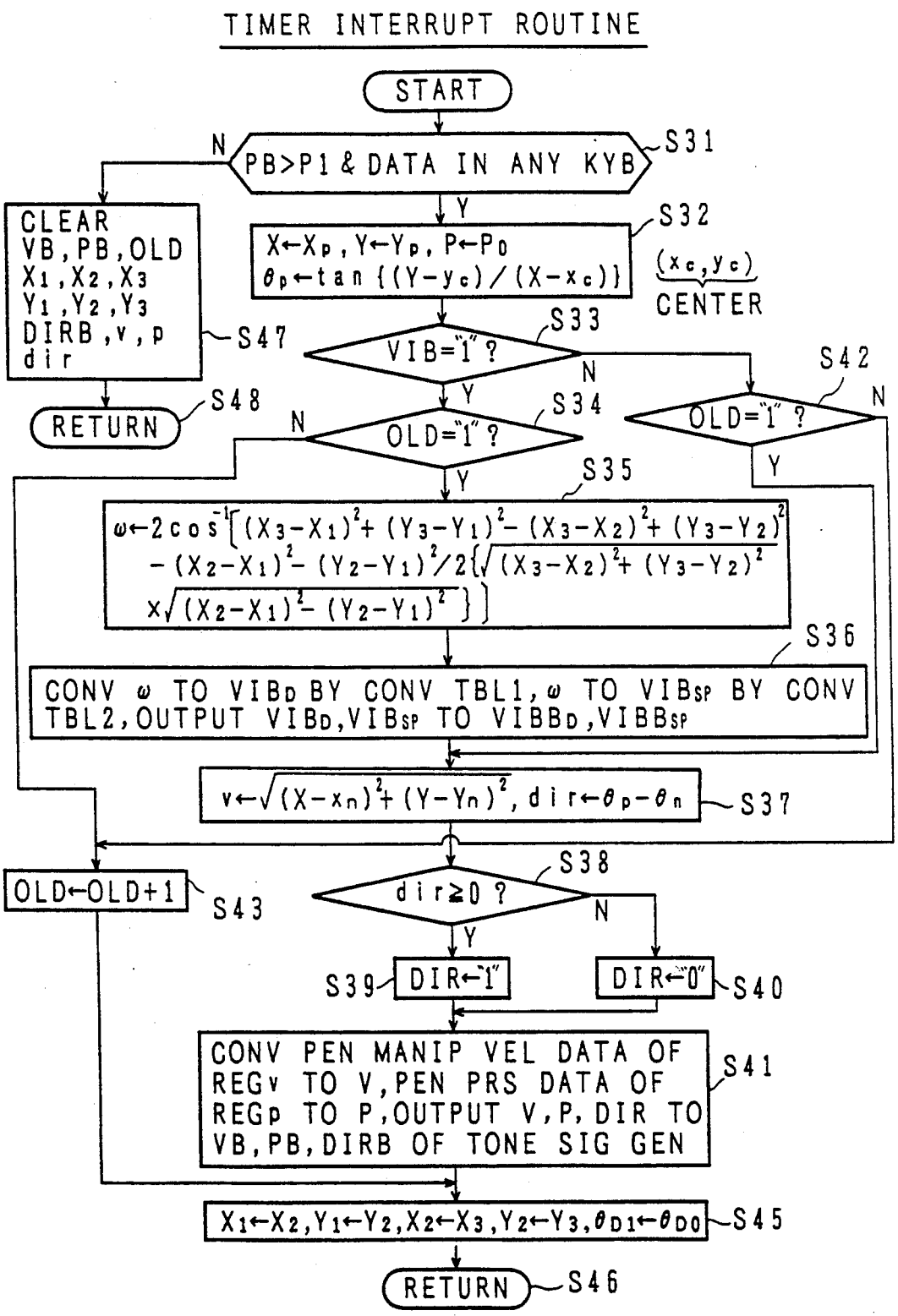
FIG. 12 is a flow chart of the timer interrupt routine.

In the following, the timer interrupt routine is described with reference to FIG. 12. First, when the timer interrupt has occurred, a judgment in the step S31 is made as to whether the pressure data PB stored in the pressure buffer is larger than a predetermined pressure $P_1$ and there is data in any of the key buffers KYB. $P_0$ is set as a very small pressure value. Namely, when pressure is applied to the plane manipulator and any key in the keyboard is depressed, a musical tone will be generated. In other words, there is no musical tone generated only by key depression or only by manipulation of the plane manipulator, thereby preventing tone generation caused by erroneous operation.

When the two conditions are satisfied, coordinates $x_p$ and $y_p$ and pressure $P_0$ which are the output signals of the plane manipulator 1 are fetched into the respective register X, Y and P in the next step S32 along the arrow Y. Also, the angle $\theta$ of the manipulation position (X, Y) with respect to the x axis as the reference axis containing the reference point ($x_c$, $y_c$) is calculated from the value of $\tan^{-1}\{(Y-y_c)/(X-x_c)\}$ and fetched into the register $\theta$p. In the next step S33, a judgment is made as to whether the data in the register VIB is "1" or not.

When the VIB is "1" as a result of the judgement in the step S33, the mode to be used is a mode for generating "vibrato" information on the basis of the locus of performance manipulation. Accordingly, in the step S34, a judgement is made as to whether the flag OLD is "1" or not. When the flag OLD is "1", the flag indicates the fact that the event has been already detected. Accordingly, the flow goes to the step S35.

In the step S35, the angle of the direction change is calculated according to the theory described above with reference to FIG. 6 and is stored in the register $\omega$. Then, the flow goes to the step S36. The values of $VIB_D$ and $VIB_{SP}$ as "vibrato" information are calculated from $\omega$ by conversion on the basis of the conversion table having the conversion characteristic described above with reference to FIG. 8 and are respectively supplied to the buffers $VIBB_D$ and $VIBB_{SP}$ in the tone signal generating circuit. Thus, the information of "vibrato" depth and "vibrato" speed is inputted into the tone signal generating circuit.

In the next step S37, the distance between the time-series position data detected in time sequence is calculated from the position data and stored in the register v representing the velocity. Also, the angle change is calculated from the angle of the manipulation position with respect to the reference axis and stored in the register dir representing the direction.

In the next step S38, a judgment is made as to whether the contents of the register dir is positive (0 or more) or not. When the register dir is not negative, the flow goes to the step S39 along the arrow Y. In the step S39, "1" is set in the register DIR. When the register dir is negative, "0" is set in the register DIR (Step S40).

Thus, the information representing the direction of the angle change is stored in the register DIR. Then, the flow goes to the step S41. In the step S41, velocity information v and pressure information p are respectively converted into the velocity data V and the pressure data P by using the table having the characteristic as shown in FIG. 13. These parameters V, P and DIR are supplied to the latch means VP, PB and DIRB in the tone signal generating means. Then, data are updated in the step S45 and the flow returns in the step S46.

When VIB is not "1" as a result of the judgment in the step S33, the flow goes to the step S42. In the step S42, a judgment is made as to whether the flag OLD is "1" or not. When the flag OLD is not "1", the flow goes to the step S43 along the arrow N and "1" is set in the flag OLD. When the flag OLD is "1" as a result of the judgment in the step S42, the flow goes to the step S37 along the arrow Y.

When the flag OLD is not "1" as a result of the judgment in the step S34, the flow goes to the step S43 along the arrow N and "1" is set in the flag OLD.

When the two conditions are not satisfied in the step S31, the flow goes to the step S47 along the arrow N and the respective registers are cleared. In the step S48, the flow returns.

Figure 13A:
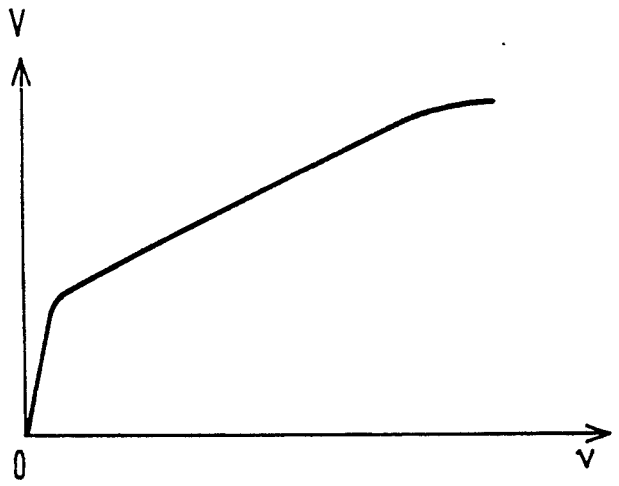
FIGS. 13A and 13B are graphs showing the characteristics of the conversion table.

In the characteristic as shown in FIG. 13A, the slope of the curve is sharp in the region where the velocity data v is small. The sharp slope in the small data region is provided so that the bow speed data is raised up to a good tone generating region rapidly even if manipulation is made at a small speed, because it is difficult to generate a good musical tone when the speed of the operation of the bow of the violin is too small.

Figure 13B:
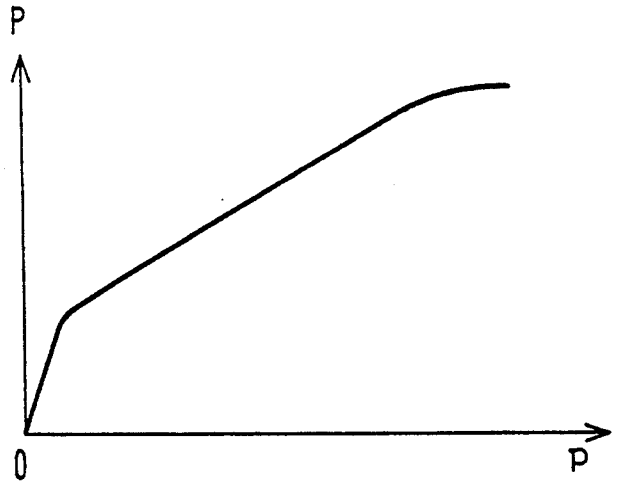

Similarly, in FIG. 13B, the slope of the curve is sharp in the region where the pressure data p is small. The sharp slope is provided to narrow a region unfit for tone generation and so that the pressure data P in a region fit for tone generation can be generated when a suitable pressure is applied.

Although description has been made on the case where "vibrato" effect is controlled on the basis of detection of the direction change in the locus of performance manipulation, other effects such as "tremolo", "celesta", "chorus", etc. may be controlled by utilizing the direction-change data.

Although description has been made on the performance of a rubbed string instrument, taking the case of the violin as an example, musical tones of other instruments can be generated by using the similar electronic musical instrument.

Although description has been made on the case where the manipulation plane 1*a* is provided with a pressure sensor, the pressure sensor may be incorporated in the pen manipulator.

Although description has been made on the manipulator having an electromagnetic coupling type two-dimensional manipulation region, the invention is not limited thereto. For example, a combination of a light pen and a light-sensitive display surface may be used as a manipulator or a three-dimensional data input device utilizing the polar coordinates may be used. The reference point may be fixed or arbitrarily settable.

Also, other hand manipulators than the pen type manipulator may be used. Although description has been made on the case where the invention is applied to performance of a rubbed string instrument, it is to be understood that the invention is not limited thereto and that the invention can be applied to performance of other instruments such as a wind instrument. Also, a waveform memory, an FM tone generator, etc. can be utilized as the tone generator as well as the physical model tone generator as described above. Exclusive-use circuits for executing the steps of the program may be used in place of the CPU, ROM and RAM.

As is described above, according to the embodiments of the present invention, new parameters for controlling musical tones can be provided by utilizing a manipulator having a manipulation region of two or more dimensions and deriving direction-change information from the locus of performance manipulation in the manipulation region.

From this information, "vibrato" information as in a rubbed string instrument or a wind instrument can be provided.

For example, the "vibrato" information, together with bow speed information and bow pressure information in a rubbed string instrument, can be provided by rotating the hand manipulator in the manipulation region.

Furthermore, parameters such as the bow moving direction, etc. can be produced by detecting the direction of the movement.

Although description has been made on the embodiments of the present invention, the present invention is not limited thereto. For example, it will be apparent for those skilled in the art that various changes, modifications, improvements and combinations thereof may be made.

What is claimed is:

1. An electronic musical instrument comprising:

manipulation means including an at least two dimensional continuous surface manipulation region, and a positioning element operative proximate said continuous surface of said manipulation region for achieving performance manipulation within said manipulation region;

means for detecting time based serial position data coordinates on the basis of serial positioning of the performance manipulation of said positioning element within said manipulation region;

means for detecting directional change and for conversion of data pertaining to a determination of the geometric coordinate locus of the performance manipulation, on the basis of a predetermined number of time based, serially detected position data coordinates; and a tone signal generation circuit for performing effect control on musical tones based on the detected position and directional change and conversion data from said means for detecting and said manipulation means.

2. An electronic musical instrument according to claim 1, wherein said positioning element of said manipulation means further comprises: a changeover switch, so that said tone signal generation circuit generates tone signals subjected to the musical tone effect control by using said directional change and conversion data when said changeover switch is set to one side, while said tone signal generation circuit generates tone signals without using said directional change and conversion data when said changeover switch is set to the other side.

3. An electronic musical instrument according to claim 1, wherein said means for detecting directional change detects an angle between a first radius and a second radius from the coordinates of three time based serially detected points under the condition that said first radius is assumed to be a linear segment between the first one of said three time based serially detected points and a center of a circle circumscribed with a triangle determined by said three time based serially detected points and said second radius is assumed to be a linear segment between the last one of said three time based serially detected points and said center.

4. An electronic musical instrument according to claim 1, wherein said means for detecting directional change detects an angle between a first direction and a second direction under the condition that said first direction and said second direction are assumed to be defined by a line connecting a pair of time based serially detected adjacent points and a line connecting a subsequent pair of time based serially detected adjacent points, respectively.

5. An electronic musical instrument according to claim 1, wherein:

said manipulation region of said manipulation means is capable of setting a reference point and a reference axis including said reference point as the origin; and said means for detecting directional change includes means for detecting temporal variation of an angle formed between the direction connecting said reference point to a position of performance manipulation within said manipulation region and said reference axis.

6. An electronic musical instrument according to claim 1, in which the musical tone effect control is one selected from "vibrator", "tremolo", "céleste", and "chorus".

7. An electronic musical instrument comprising:

manipulation means, including a manipulation region having at least two dimensions and a positioning element, for achieving performance manipulation by physically contacting said manipulation region with said positioning element and sensing the contact;

first detecting means for detecting coordinate position data on the basis of the performance manipulation of said positioning element executed within said manipulation region;

calculation means for calculating a geometric coordinate locus based on said coordinate position data from said first detecting means;

second detecting means for determining directional data in accordance with the calculated locus and the detected position data; and effect control means for controlling musical tone effect on the basis of the directional data.

8. An electronic musical instrument comprising:

manipulation means for defining a manipulation region having at least two dimensions and a positioning element operative for achieving performance manipulation within said manipulation region;

first detecting means for detecting coordinate position data on the basis of the performance manipulation of said positioning element executed within said manipulation region;

calculation means for calculating a geometric coordinate locus based on said coordinate position data from said first detecting means;

second detecting means for determining directional data in accordance with the calculated locus and the detected position data;

third detecting means for detecting pressure applied on said manipulation region by said positioning element and for outputting corresponding pressure data; and effect control means for controlling musical tone effect on the basis of the directional data.

9. An electronic musical instrument according to claim 8, further comprising second calculation means for calculating speed data on the basis of said coordinate position data from said first detecting means.

10. An electronic musical instrument according to claim 9, further comprising:

tone generating means for generating musical tone, said tone generating means including;

circulating means, which includes signal paths each having two directions, for circulating a signal, a non-linear circuit for storing characteristics of a musical instrument and for mixing said signal circulated in said circulating means and said speed data on the basis of said pressure data, delay means for delaying said signal in said circulating means, wherein said signal circulated in said circulating means is fed back to said non-linear circuit to thereby generate a musical tone.

11. An electronic musical instrument comprising:

manipulation means for defining a manipulation region having at least two dimensions and a positioning element operative for achieving performance manipulation within said manipulation region, wherein said manipulation region of said manipulation means comprises a flat plane surface and said manipulation means further includes a first plurality of detection lines arranged parallel to a first axis and a second plurality of detection lines arranged parallel to a second axis, wherein said first and second detection lines are proximate an underside of said flat plane surface;

first detecting means for detecting coordinate position data on the basis of the performance manipulation of said positioning element executed within said manipulation region;

calculation means for calculating a geometric coordinate locus based on said coordinate position data from said first detecting means;

second detecting means for determining directional data in accordance with the calculated locus and the detected position data; and effect control means for controlling musical tone effect on the basis of the directional data.

12. An electronic musical instrument according to claim 11 wherein said positioning element comprises a pen-shaped movable hand manipulator operative to generate an electromagnetic field proximate a tip thereof, said electromagnetic field produced by said pen-shaped movable hand manipulator capable of generating a field which is sensed by said first and second detection lines of said manipulation region to determine an ordinate position of said hand manipulator with respect to the flat plane surface of said manipulation region.

13. An electronic musical instrument comprising:

manipulation means, including a two dimensional manipulation region and a positioning element employed by a performer to indicate a position on the manipulation region, for providing position data;

means for detecting a sequential series of position data in response to movement of the positioning element with respect to the manipulation region;

means for analyzing the series of position data to detect directional changes in the motion of the positioning element with respect to the manipulation region;

a tone signal generation circuit for generating a musical tone; and means for controlling an effect to be imparted to the musical tone in response to the position data and the detected directional changes.

* * * * *